US012000096B2

(12) United States Patent
Thiesse

(10) Patent No.: US 12,000,096 B2
(45) Date of Patent: Jun. 4, 2024

(54) AUGER SEGMENT AND SYSTEMS, ASSEMBLIES, AND METHODS THEREOF

(71) Applicant: Caterpillar Paving Products Inc., Brooklyn Park, MN (US)

(72) Inventor: Chad M. Thiesse, Brooklyn Park, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 687 days.

(21) Appl. No.: 17/165,454

(22) Filed: Feb. 2, 2021

(65) Prior Publication Data

US 2022/0243405 A1 Aug. 4, 2022

(51) Int. Cl.
*E01C 19/48* (2006.01)
*E01C 19/20* (2006.01)

(52) U.S. Cl.
CPC ..... *E01C 19/202* (2013.01); *E01C 19/48* (2013.01); *E01C 2019/208* (2013.01)

(58) Field of Classification Search
CPC ... E01C 19/202; E01C 19/48; E01C 2019/208
USPC ..... 404/72, 101, 118
See application file for complete search history.

(56) References Cited

U.S. PATENT DOCUMENTS 3,015,258 A * 1/1962 Apel ..... E01C 19/42 37/388
4,708,519 A * 11/1987 Davin ..... E01C 19/42 404/101
6,899,490 B2 * 5/2005 Lee ..... E01C 19/4873 404/101
9,340,365 B2 5/2016 Erdtmann et al.
10,228,293 B2 3/2019 Marsolek
10,273,640 B1 4/2019 Boston et al.
10,316,475 B2 6/2019 Busch
(Continued)

FOREIGN PATENT DOCUMENTS

CN 202298419 U 7/2012
CN 109468916 A 3/2019
CN 210702361 U 6/2020
(Continued)

OTHER PUBLICATIONS

Deshan Engineers, "Vogele Paver Auger Blade" Available Online at: https://www.indiamart.com/proddetail/vogele-paver-auger-blade-17781905262.html, 2020, pp. 1-9.

*Primary Examiner* — Raymond W Addie
(74) *Attorney, Agent, or Firm* — Patrick L. Miller; XSENSUS, L.L.P.

(57) ABSTRACT

An auger segment can comprise a base having a first end, a second end opposite the first end in a length direction of the base, a first side, and a second side opposite the first side; a first receptacle projecting from the first side of the base; a second receptacle projecting from the first side of the base; and a flight projecting from the first side of the base between the first receptacle and the second receptacle. A first recess of the first receptacle can be defined by a first sidewall thereof and a second recess of the second receptacle can be defined by a second sidewall thereof. A first through hole can extend through the base in the first recess of the first receptacle and a second through hole can extend through the base in the second recess of the second receptacle.

16 Claims, 7 Drawing Sheets

(56) References Cited

U.S. PATENT DOCUMENTS

2004/0179895 A1* 9/2004 Lee ..... E01C 19/405
404/101
2012/0288329 A1* 11/2012 Weiler ..... E01C 19/1054
404/92

FOREIGN PATENT DOCUMENTS

EP 0261093 B1 7/1991
EP 1120495 A1 8/2001

* cited by examiner

AUGER SEGMENT AND SYSTEMS, ASSEMBLIES, AND METHODS THEREOF

TECHNICAL FIELD

The present disclosure relates to paving machines, and more particularly to augers of paving machines and segments, systems, assemblies, and methods thereof.

BACKGROUND

Asphalt pavers include an auger to spread asphalt in front of a screed as part of a paving process. The auger may include a plurality of auger segments connected to an auger shaft. During the paving process the auger segments, rotating with the auger shaft, spread the asphalt in front of the screed. The abrasiveness of the asphalt can cause the auger segments to wear over time. As such, the auger segments may need to be replaced when worn.

However, auger segment replacement may be challenging due to limited accessibility to the auger segment and/or the buildup of asphalt material around fastening interfaces coupling the auger segment to the auger shaft. For instance, for removal and installation a mechanic may need to lay on the ground and slide under the asphalt paver to access the auger segments, along with potentially needing to use two wrenches (or the like) on opposite sides of the auger segment and consequently both hands to remove the worn auger segment and install the new auger segment. Moreover, if asphalt has built up around the fastening interfaces then the mechanic may need to clear the buildup prior to removal of the auger segment.

Chinese Patent Document CN 202298419 ("the CN '419 patent document") describes a protection liner for an auger shaft of a spreading machine. The CN '419 patent document describes that a mounting hole is arranged on the protection liner, the protection liner is arranged at a side part of the auger shaft, and a blade is fixedly connected to outside the protection liner. According to the CN '419 patent document, the protection liner has the beneficial effects that the structure is simple, the installation is convenient, the auger shaft is effectively protected from damage of high-temperature pitch, and the service life of the auger shaft is prolonged.

SUMMARY

According to an aspect an auger segment is described or provided. The auger segment can comprise a base having a first end, a second end opposite the first end in a length direction of the base, a first side, and a second side opposite the first side; a first receptacle projecting from the first side of the base; a second receptacle projecting from the first side of the base; and a flight projecting from the first side of the base between the first receptacle and the second receptacle. A first recess of the first receptacle can be defined by a first sidewall thereof and a second recess of the second receptacle can be defined by a second sidewall thereof, where a volume and/or area of the first recess can be less than that of the second recess. A first through hole can extend through the base in the first recess of the first receptacle. And a second through hole can extend through the base in the second recess of the second receptacle.

In another aspect, a method regarding an auger assembly for a paving machine is disclosed or implemented. The method can comprise providing a first auger segment adapted to be removably coupled to a rotatable shaft; and/or providing a second auger segment adapted to be removably coupled to the rotatable shaft. Each of the first and second auger segments can include a base having a first end, a second end opposite the first end in a length direction of the base, a first face, and a second face opposite the first face; a flight extending from the first face of the base between the first end and the second end of the base; a first receptacle at the first end of the base defining a first recess to receive a first fastener, the first receptacle extending from the first face of the base between the first end of the base and the flight; a second receptacle at the second end of the base defining a second recess to receive a second fastener, the second receptacle extending from the first face of the base between the second end of the base and the flight; a first channel between the flight and the first receptacle, and a second channel between the flight and the second receptacle.

And in another aspect an auger assembly for a paving machine is disclosed or provided. The auger assembly can comprise a shaft rotatable in a clockwise direction and a counterclockwise direction; at least one auger segment removably coupled to the shaft to rotate with the shaft; and a first bolt and nut fastener and a second bolt and nut fastener to removably couple the at least one auger segment to the shaft. The at least one auger segment may be formed in one-piece and can include a base having a first end portion, a second end portion opposite the first end portion in a length direction of the base, a first face, and a second face opposite the first face, the second face directly contacting the shaft; a blade extending from the first face of the base between the first end portion and the second end portion; a first receptacle to receive the first bolt and nut fastener, the first receptacle extending from the first face of the base; a second receptacle to receive the second bolt and nut fastener, the second receptacle extending from the first face of the base; a first channel between the blade and the first receptacle; and a second channel between the blade and the second receptacle.

Other features and aspects of this disclosure will be apparent from the following description and the accompanying drawings.

DETAILED DESCRIPTION

The present disclosure relates to paving machines, and more particularly to augers of paving machines and segments, systems, assemblies, and methods thereof.

Figure 1:
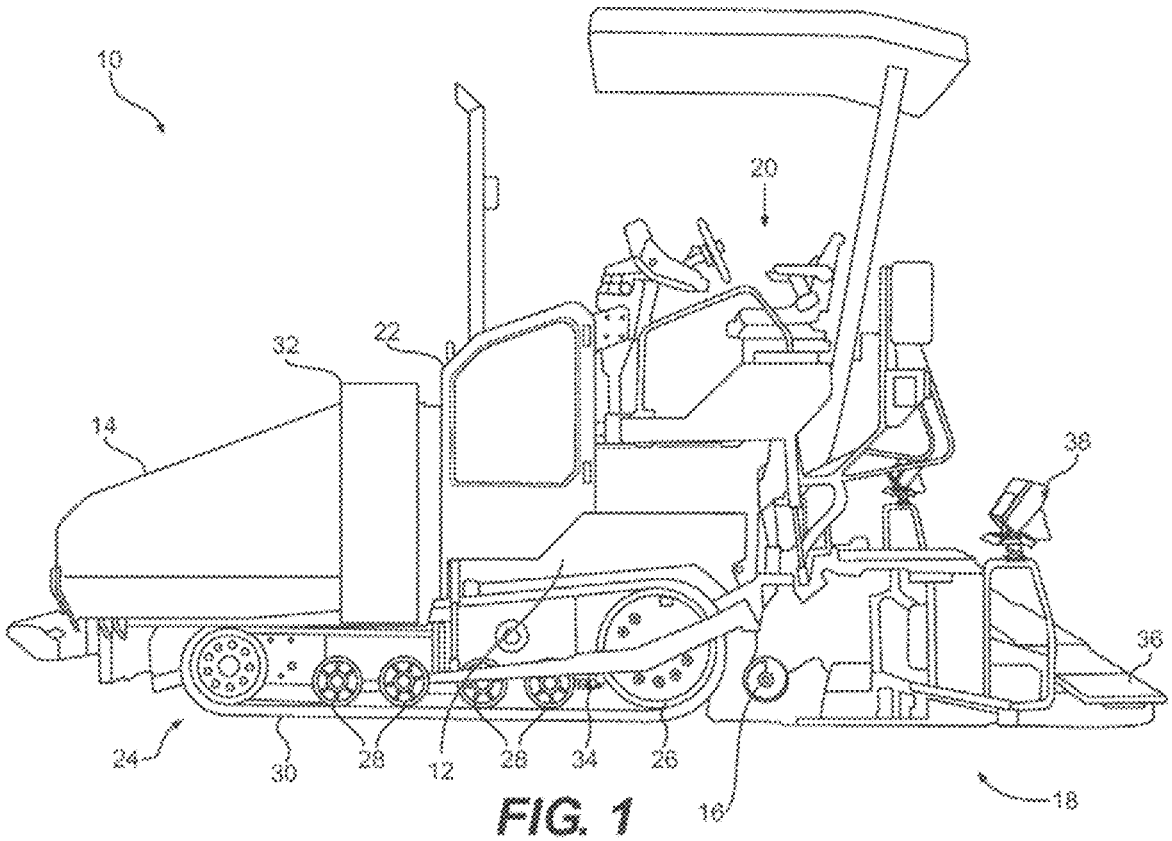
FIG. 1 is a side view of a paving machine according to one or more embodiments of the disclosed subject matter.
Figure 2:
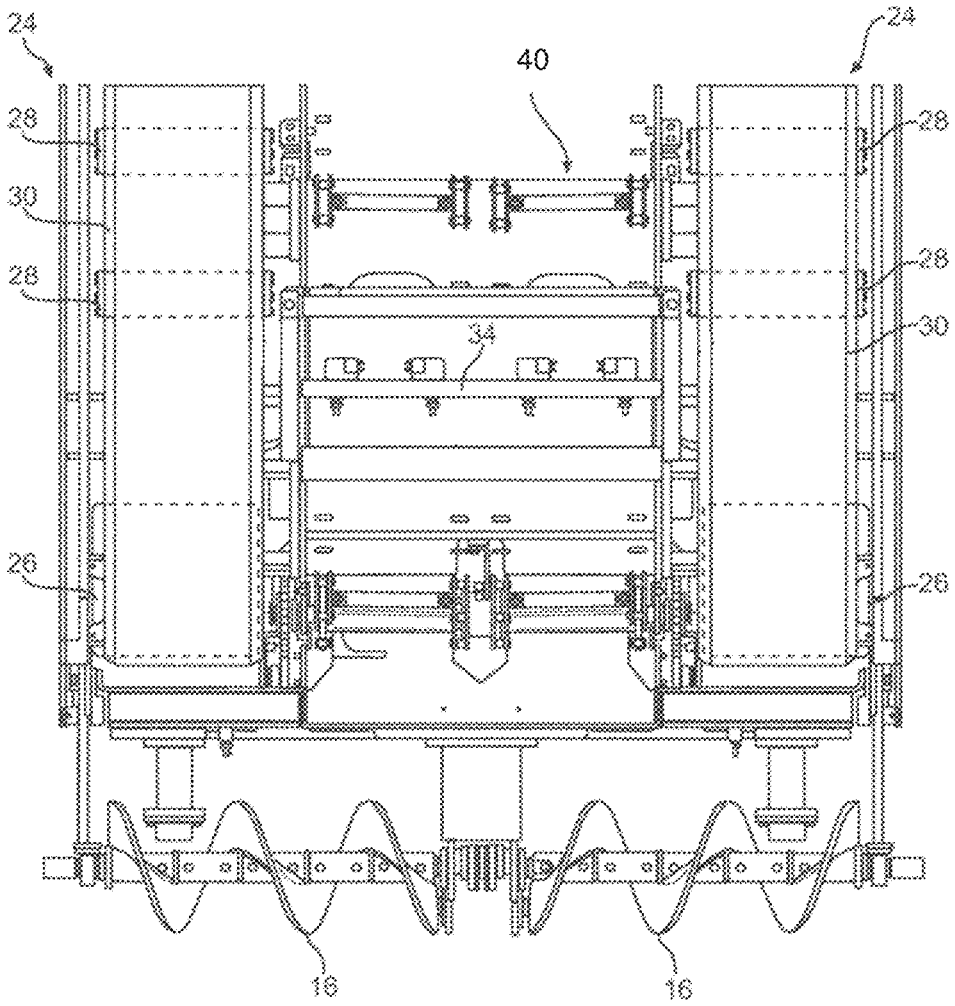
FIG. 2 is a bottom view of a portion of the paving machine of FIG. 1.

FIG. 1 and FIG. 2 illustrate a side view and a bottom view, respectively, of an exemplary paving machine 10 according to one or more embodiments of the present disclosure. Paving machines according to embodiments of the disclosed subject matter, such as paving machine 10, may be referred to herein as a paver or an asphalt paver. Moreover, paving machines or pavers, according to embodiments of the disclosed subject matter, may encompass various types or configurations of paving machines, such as paver finishers, asphalt finishers, or other types or configurations of paving machines that implement one or more augers.

Paving machine 10 can include a frame 12, a hopper 14, an auger 16, and a screed 18. Paving machine 10 may also include an operator station 20, from which an operator may maneuver and control the paving machine 10. Generally, paving machine 10 may be propelled by an engine assembly 22 to power a drive assembly 24, which may include a drive wheel 26, one or more idlers 28, and tracks 30.

Optionally, the paving machine 10 can include a tank 32 and a spray bar 34. The tank 32 may contain a treatment fluid or emulsion fluid, for example, a binding material, to be delivered to an underlying ground surface by the spray bar 34 prior to delivery of paving material to the underlying ground material. Paving material, as used herein, can mean or include bitumen or asphalt, particularly bitumen or asphalt concrete. As used herein, the term "ground surface" can broadly refer to all types of surfaces that form typical roadways (e.g., asphalt, cement, clay, sand, dirt, etc.) or upon which paving material may be deposited in the formation of paved surfaces.

The hopper 14 can be positioned in a forward portion of the frame 12 to receive or store the paving material, for example, received from a mixer truck. A conveyor assembly 40 can connect the hopper 14 to the auger 16, such as shown in FIG. 2, to convey the paving material from the hopper 14 to the auger 16.

The auger 16, which can have multiple auger portions 16 that run in a width-wise direction of the paving machine 10, can receive the paving material from the conveyor assembly 40 and spread the paving material about the ground surface, for example, outward in opposite directions from a longitudinal center line of the paving machine 10, in front of the screed 18.

Screed 18 can be positioned to the rear of auger 16, such as shown in FIG. 1, and can spread and smooth the paving material delivered by the auger 16 to the paving surface. One or more operator positions 36 on which an operator may stand may be provided above or as part of the screed 18. A control interface 38, which may include a monitor and/or a control panel, can be provided relative to the one or more operator positions 36 and accessible by the operator positioned at one of the one or more operator positions 36 to operate the screed 18 of the paving machine 10. For instance, the height of screed 18 may be adjustable via the control interface 38.

Figure 3:
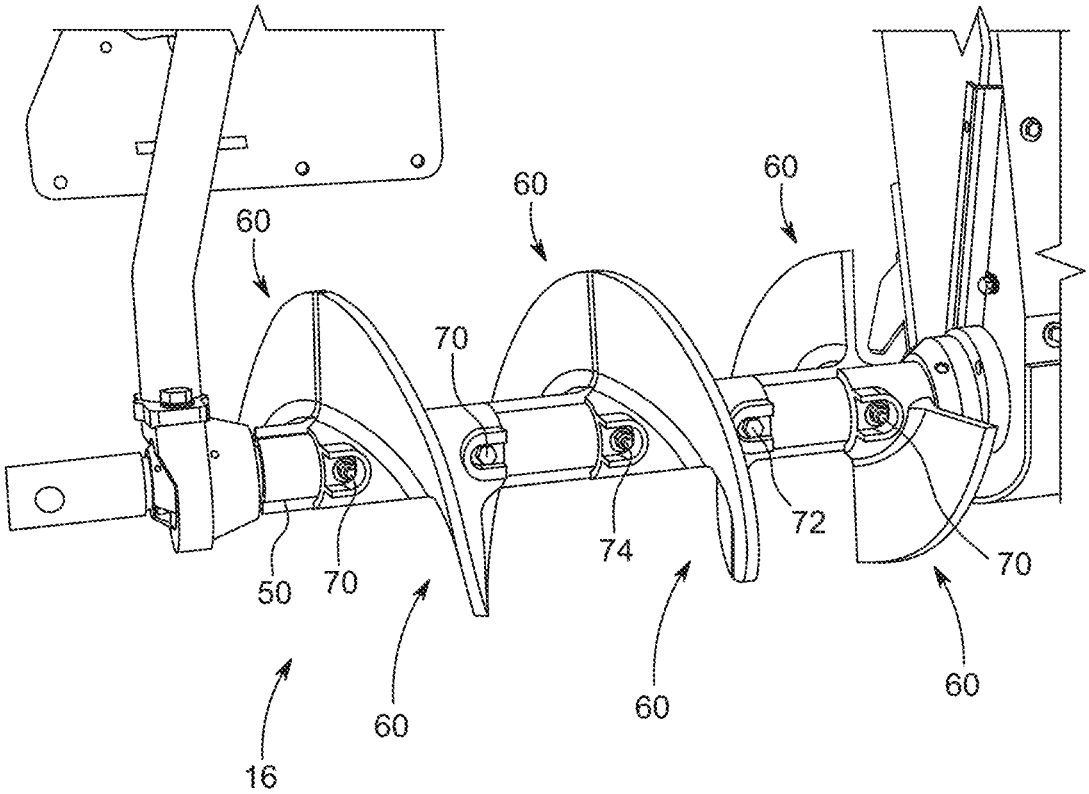
FIG. 3 shows a portion of an auger of a paving machine according to one or more embodiments of the disclosed subject matter.
Figure 4:
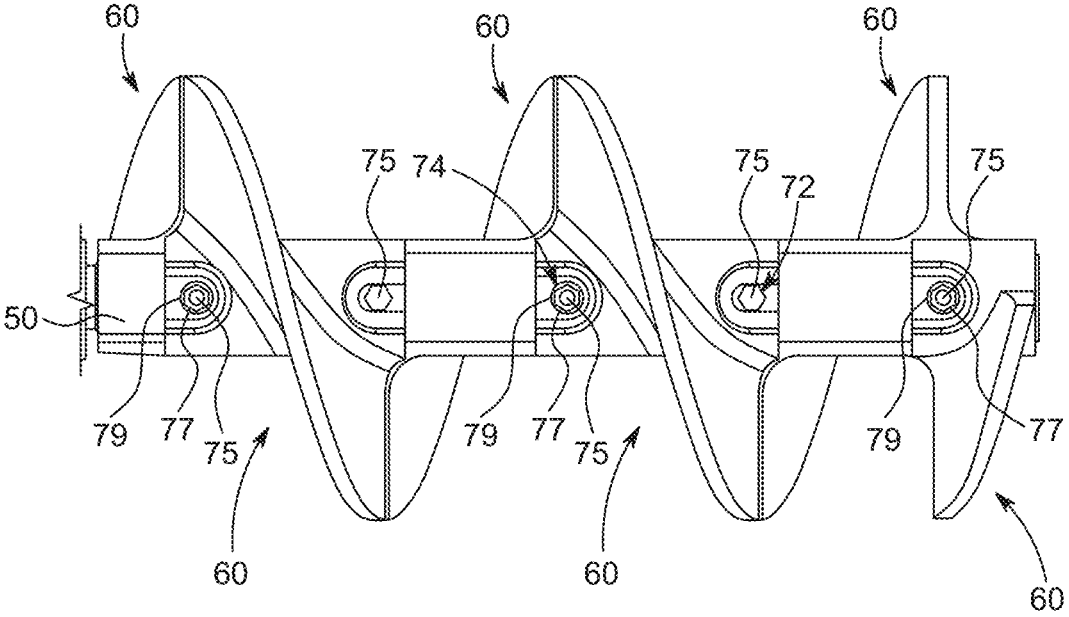
FIG. 4 is an elevational or plan view of a portion of the auger of FIG. 3.
Figure 5:
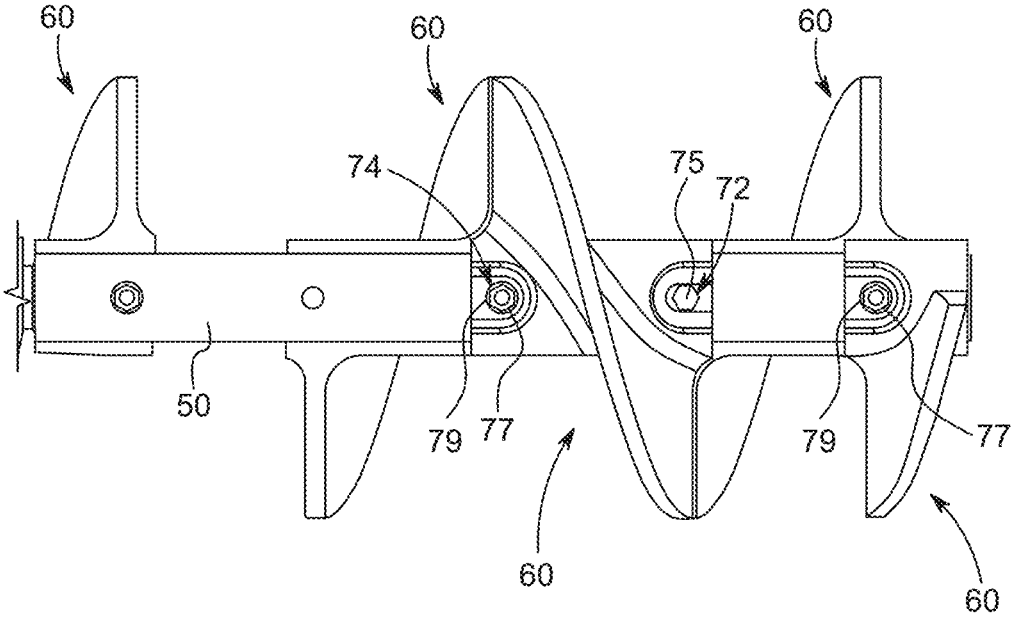
FIG. 5 shows the portion of the auger of FIG. 4 with one of the auger segments removed.

Referring now to FIGS. 3-5, the auger 16 can be comprised of a shaft 50, which can rotate clockwise and counterclockwise, and a plurality of auger segments 60. The shaft 50 may be referred to herein as a rotatable shaft 50.

An array of the auger segments 60 can be mounted to the shaft 50. More specifically, according to embodiments of the disclosed subject matter, each of the auger segments 60 can be removably coupled to the shaft 50 via one fastener 70 or a pair of fasteners 70, depending upon the configuration of the auger segment 60. In the case of two fasteners per auger segment 60, the pair of fasteners 70 may be referred to as a first fastener 72 and a second fastener 74. One or more auger segments 60 coupled to the shaft 50 via respective one or more of the fasteners 70 may be characterized as an auger assembly. Here, in FIG. 3, auger segments 60 at opposite ends of the auger portion of the auger 16 can be coupled to the shaft 50 via one fastener 70, whereas auger segments 60 between the end auger segments 60 can be coupled to the shaft 50 via the first fastener 72 and the second fastener 74. Embodiments of the disclosed subject matter, however, are not limited to single-fastener auger segments 60 at the ends of the auger portion. Optionally, each of the auger segments 60 may directly contact the shaft 50 when removably coupled to the shaft 50.

The auger segments 60 can be provided along the shaft 50 in a longitudinal direction of the shaft 50. Moreover, the auger segments 60 can be arranged along the shaft 50 so as to alternately face opposite directions relative to each immediately adjacent auger segment 60. Auger segments 60 can form a continuous or substantially continuous helix shape along the shaft 50, such as shown in FIGS. 3-5. Here, each auger segment 60 can be an individual flight, turn, or wrap of the helix shape along the shaft 50. For instance, each of the auger segments 60 can wrap around half or approximately half (i.e., 180 degrees) of the circumference of the shaft 50, and thus may each contribute 180 degrees (or substantially 180 degrees if spacing between facing auger segments 60) to helix shape.

In that the auger segments 60 can form a continuous or substantially continuous helix shape as discussed above, rear faces or sides of the auger segments 60 may contact rear faces or sides of each immediately adjacent auger segment 60. Alternatively, the rear faces or sides of immediately adjacent auger segments 60 may be spaced from each other. According to one or more embodiments, a portion of the shaft 50 between adjacent auger segments 60 on the same side of the shaft 50 can be exposed, that is, not covered by any of the auger segments 60, such as shown in FIG. 3 and FIG. 4.

The auger segments 60 may be referred to herein as including at least first and second auger segments 60. In this regard, in some instances the first and second auger segments 60 may be referencing two auger segments 60 on a same side of the shaft 50 (i.e., facing the same direction). In other instances, the first and second auger segments 60 may be referencing two auger segments 60 on opposite sides of the shaft 50 (i.e., facing opposite directions). Such first and second auger segments 60, whether on the same side of the shaft 50 or on opposite sides of the shaft 50, may be adjacent to each other or non-adjacent to each other. Non-adjacent can mean that one or more intervening auger segments 60 on the same side of the shaft 50 and/or one or more intervening auger segments 60 on the opposite side of the shaft 50 can be between the first and second auger segments 60.

Referring to FIG. 4 and FIG. 5, each of the fasteners 70 can include a bolt 75 and a nut 77. The nut 77 can be threaded to a threaded end of the bolt 75 opposite the bolt head. The threaded end of the bolt 75 may be referred to herein as a free end of the bolt 75 opposite the bolt head of the bolt 75. Thus, according to embodiments of the disclosed subject matter, each fastener 70 can be characterized or referred to as a bolt and nut fastener. Optionally, each fastener 70 can include a washer 79 between the nut 77 and the auger segment 60.

As shown in FIGS. 3-5, the fasteners 70 can alternate in orientation along the shaft 50. That is, each fastener 70 can face a different direction relative to each immediately adjacent fastener 70. In this regard, the fasteners 70 for each dual-fastener auger segment 60 can face different directions.

More specifically, the first fastener 72 and the second fastener 74 can extend through the auger segment 60 such that the bolt head of the bolt 75 and the nut 77 (and optional washer 79) are on the same side of the auger assembly, such as shown in FIGS. 3-5.

According to one or more embodiments, each bolt 75 can extend entirely through one auger segment 60 on one side of the shaft 50, the shaft 50 (via opposing through holes in the shaft 50), and another auger segment 60 on the other side of the shaft 50. Thus, one fastener 70, at least in part, can fasten two auger segments 60 to opposite sides of the shaft 50. Put another way, one fastener 70 can be shared by two auger segments 60.

As noted above, the bolts 75 can be alternately provided through the auger segments 60 and the shaft 50 such that the direction of the bolts 75 alternates between facing a first direction and facing a second direction along the length of the shaft 50. Thus, for one auger segment 60, the bolt 75 of the first fastener 72 can extend through the auger segment 60 (and the shaft 50 and another auger segment 60 on an opposite side of the shaft 50) in the first direction and the bolt 75 of the second fastener 74 can extend through the auger segment 60 (after going through yet another auger segment 60 on the opposite side of the shaft 50 and the shaft 50) in the second direction opposite the first direction. As a result, the bolt head of the bolt 75 of the first fastener 72 and the nut 77 of the second fastener 74 can be on the same side of the auger segment 60 and the shaft 50.

Figure 6:
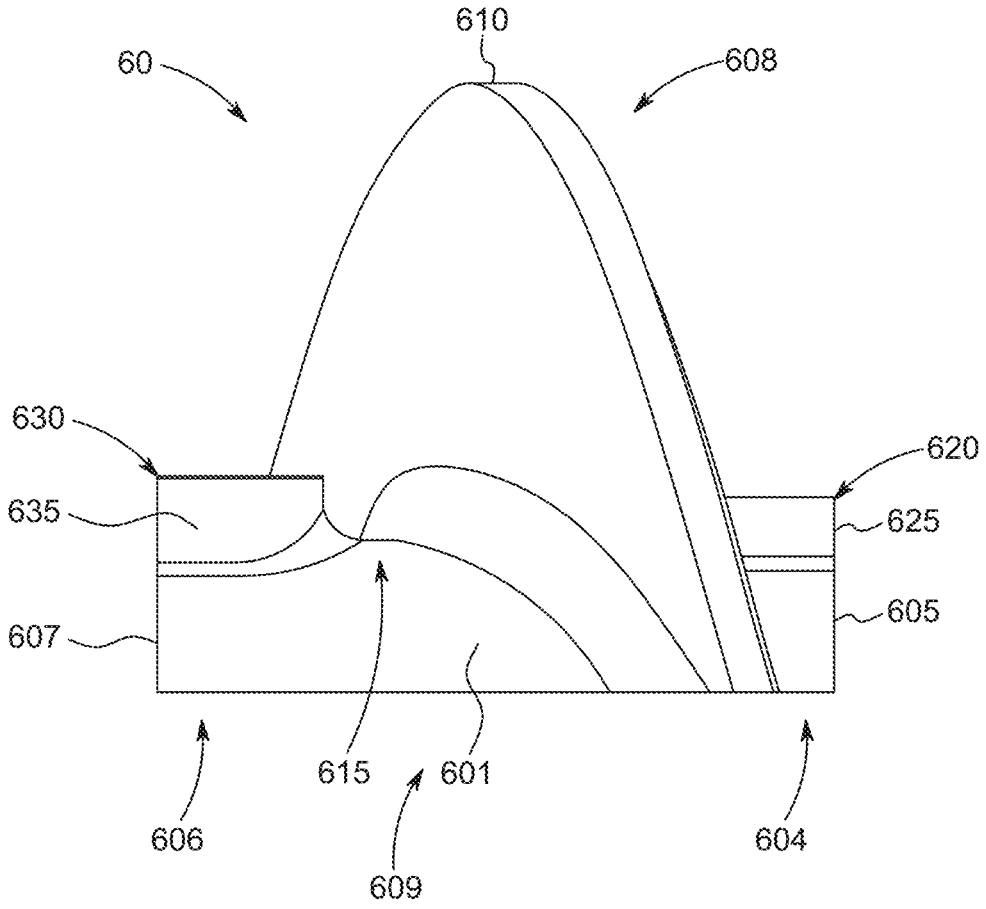
FIG. 6 is a side elevational view of an auger segment according to one or more embodiments of the disclosed subject matter.
Figure 7:
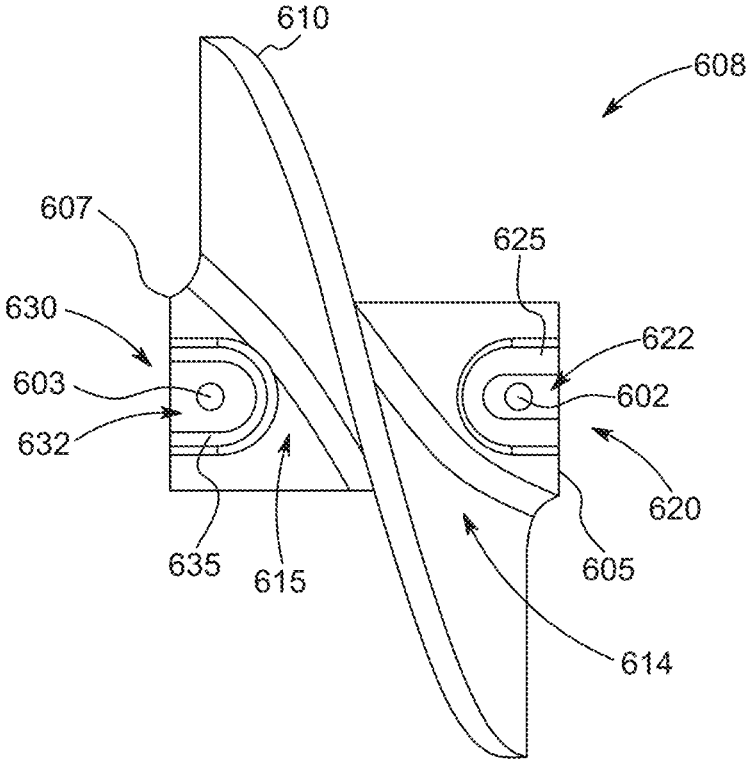
FIG. 7 is a top plan view of the auger segment of FIG. 6.
Figure 8:
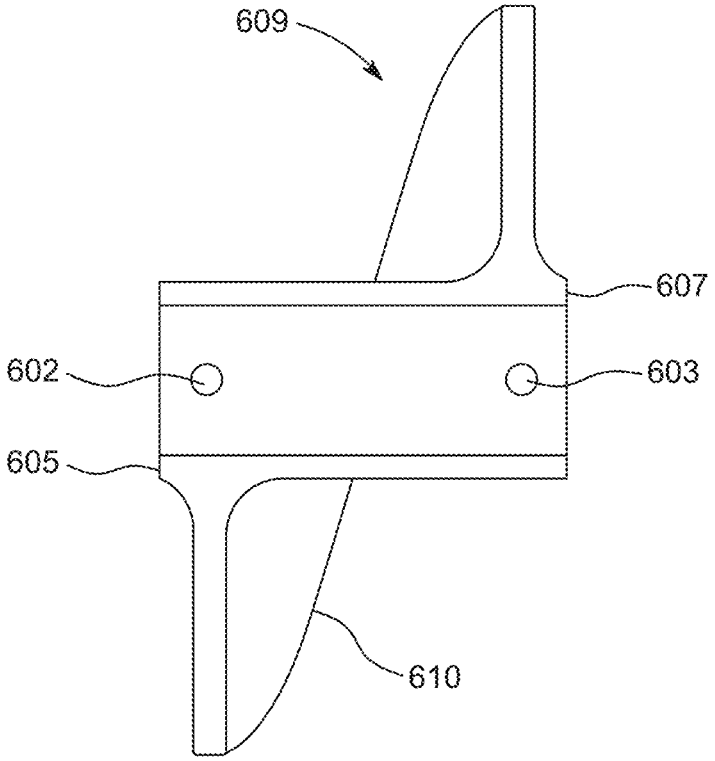
FIG. 8 is a bottom plan view of the auger segment of FIG. 6.

Turning now to FIGS. 6-8, these figures show auger segment 60 according to one or more embodiments of the disclosed subject matter. The auger segment 60 can be formed as a one-piece or unitary casting or weldment made, for instance, of a metal or metallic material (e.g., steel).

The auger segment 60 can include a base or body 601, a blade or flight 610, a first receptacle 620, and a second receptacle 630. Discussed in more detail below, the body 601 can also include a first through hole 602 and a second through hole 603 to receive bolts 75 of the first fastener 72 and the second fastener 74, respectively. Likewise, according to one or more embodiments, the first receptacle 620 can receive the first fastener 72 and the second receptacle 630 can receive the second fastener 74, as described above. In this regard, the first receptacle 620 and the second receptacle 630 can be the only fastener receptacles of the auger segment 60. That is, according to one or more embodiments the auger segment 60 may have only two receptacles to receive respective fasteners 70, the first receptacle 620 and the second receptacle 630.

The auger segment 60 can have a first end portion 604 defining a first end 605, a second end portion 606 defining a second end 607 opposite the first end 605, a first side or face 608, and a second side or face 609 opposite the first face 608. A distance or direction from the first end 605 to the second end 607 can be referred to as a length or a length direction, respectively, of the auger segment 60.

Referring to FIG. 8, the second face 609 of the auger segment 60 can have or otherwise be defined by a cut-out or recessed portion that takes the shape of a portion of the circumference of the shaft 50. As such, as noted above, the second face 609 of the auger segment 60 can wrap around that portion of the circumference of the shaft 50 and directly interface with the shaft 50 when the auger segment 60 is removably coupled to the shaft 50 via one or more fasteners 70.

The flight 610 can extend from the auger segment 60 a first face 608 side of the auger segment 60 such as shown in FIG. 6 and FIG. 7. Moreover, the flight 610 can extend between the first end 605 and the second end 607 of the auger segment 60. In that the flight 610 can define a portion of a helix shape as noted above, a first end of the flight 610 can be closer to the first end 605 of the auger segment 60 than to the second end 607 of the auger segment 60. Likewise, a second end of the flight 610 can be closer to the second end 607 of the auger segment 60 than to the first end 605 of the auger segment 60. According to one or more embodiments, opposite ends of the flight 610 can be offset or inward from the first end 605 and the second end 607 of the auger segment 60, such as shown in FIG. 7 and FIG. 8.

The first receptacle 620 can extend from the body 601 at the first face 608 side of the auger segment 60. More specifically, the first receptacle 620 can extend or project from the body 601 at the first end portion 604 of the auger segment 60. According to one or more embodiments, the first receptacle 620 can be provided at the first end 605 of the auger segment 60 and extend inward toward the flight 610.

The second receptacle 630 can extend from the body 601 at the first face 608 side of the auger segment 60. More specifically, the second receptacle 630 can extend or project from the body 601 at the second end portion 606 of the auger segment 60. According to one or more embodiments, the second receptacle 630 can be provided at the second end 607 of the auger segment 60 and extend inward toward the flight 610.

The flight 610 can extend from the body 601 between the first receptacle 620 and the second receptacle 630. However, the flight 610 may not directly contact the first receptacle 620 and/or the second receptacle 630. That is, respective spaces may be provided between the flight 610 and each of the first receptacle 620 and the second receptacle 630. Such spaces may be referred to herein as channels, particularly a first channel 614 and a second channel 615. Generally, the first channel 614 and the second channel 615 can be defined by a gradual transition according to a curvature from the flight 610 toward and to the body 601 and then to the first receptacle 620 and the second receptacle 630 on opposite sides of the flight 610.

Turning back to the first receptacle 620, the first receptacle 620 can include a first sidewall 625 that extends or projects from the body 601 such as shown in FIG. 6. According to one or more embodiments, the first sidewall 625 of the first receptacle 620 can be in the form of a 'U' or be U-shaped in the top plan view of the auger segment 60. FIG. 7 shows an example of such U-shape configuration. Here, the open face of the U-shape of the first sidewall 625 can be at the first end 605 of the auger segment 60 and face away from the second receptacle 630. Additionally, opposite sides of the first sidewall 625 may extend parallel to each other.

The first sidewall 625 can define a first void or recess 622 of the first receptacle 620. As shown in FIG. 7, for instance, the first through hole 602 can be provided in the first recess 622 in the top plan view of the auger segment 60. The first recess 622 can receive the first fastener 72, particularly the bolt head of the bolt 75 of the first fastener 72, as discussed above.

Like the first receptacle 620, the second receptacle 630 can include a second sidewall 635 that extends or projects from the body 601 such as shown in FIG. 6. According to one or more embodiments, the second sidewall 635 of the second receptacle 630 can be in the form of a 'U' or be U-shaped in the top plan view of the auger segment 60. FIG. 7 shows an example of such U-shape configuration. Here, the open face of the U-shape of the second sidewall 635 can be at the second end 607 of the auger segment 60 and face away from the first receptacle 620. Additionally, opposite sides of the second sidewall 635 may extend parallel to each other.

The second sidewall 635 can define a second void or recess 632 of the second receptacle 630. As shown in FIG. 7, for instance, the second through hole 603 can be provided in the second recess 632 in the top plan view of the auger segment 60. The second recess 632 can receive the second fastener 74, particularly the nut 77 and optional washer 79 of the second fastener 74, as discussed above.

A thickness of the first sidewall 625 can be greater than a thickness of the second sidewall 635, at least in the top plan view of the auger segment 60. That is, the thickness of some or all of the first sidewall 625 can be greater than the thickness of the second sidewall 635 at least in the top plan view of the auger segment 60. According to one or more embodiments, the thickness of the first sidewall 625 can vary from thick to thin on opposite sides of the first recess 622 from the first end 605 of the auger segment 60 toward the flight 610 such as shown in FIG. 7. Alternatively, the first sidewall 625 can have uniform thickness in the top plan view of the auger segment 60. The thickness of the second sidewall 635, according to one or more embodiments, can be uniform in the top plan view of the auger segment 60, such as shown in FIG. 7.

The heights of the first sidewall 625 and the second sidewall 635, i.e., the amounts by which the first sidewall 625 and the second sidewall 635 respectively project from the body 601, can be different. For instance, the second sidewall 635 may have a height greater than that of the first sidewall 625, such as shown in FIG. 6. Alternatively, the heights of the first sidewall 625 and the second sidewall 635 may be the same.

In light of at least the different thicknesses of the first sidewall 625 and the second sidewall 635 in the top plan view of the auger segment 60, a first volume of the first receptacle 620, as defined by the first sidewall 625, can be less than a second volume of the second receptacle 630, as defined by the second sidewall 635. Additionally or alternatively, a first area of the first recess 622, as defined by the first sidewall 625 in the top plan view of the auger segment 60, can be less than a second area of the second recess 632, as defined by the second sidewall 635 in the top plan view of the auger segment 60. Put another way, in the top plan view of the auger segment 60 a first inner perimeter of the first sidewall 625 can define a first area that is less than a second area defined by a second inner perimeter of the second sidewall 635 of the second receptacle 630. Generally, the first volume and the first area of the first receptacle 620 can be sized and shaped to accommodate the bolt head of the bolt 75 and the second volume and the second area of the second receptacle 630 can be sized and shaped to accommodate the nut 77 and the washer 79.

According to one or more embodiments, one or more outer dimensions of the first sidewall 625 and the second sidewall 635 can be the same. For instance, in the top plan view of the auger segment 60 some or all of a first outer perimeter of the first sidewall 625 can be the same as a second outer perimeter of the second sidewall 635. Optionally, all of the first outer perimeter of the first sidewall 625 and the second outer perimeter of the second sidewall 635 can match in the top plan view of the auger segment 60.

INDUSTRIAL APPLICABILITY

As noted above, the present disclosure relates to paving machines, and more particularly to augers of paving machines and segments, systems, assemblies, and methods thereof.

Embodiments of the disclosed subject matter can involve an auger segment with a raised portion provided around a bolt head of a fastener, where the bolt head can be positioned in a depression or recess created or defined by the raised portion. The raised portion can correspond to receptacles as described herein. The raised portion may be generally U-shaped and may be an integral part of the auger section (e.g., casting or a weldment onto the auger section). The geometry of the raised portion, particular inner wall portions thereof, can be sized to accommodate the bolt head (e.g., a hex shaped bolt head) such that one or more side surfaces of the bolt head abut corresponding inner wall portions and can thus be prevented from rotating when threading or unthreading a nut on the opposite threaded end of the bolt. For instance, the two flats of the "U" can match the bolt head width exactly (or slightly oversize to accommodate tolerances). In this example, these two flats of the "U" can then contact/engage and hold two of the parallel sides of the bolt head (e.g., hex geometry), thus preventing the bolt from spinning while the nut is being installed/tightened on the bolt (and likewise loosened). With this feature, the mechanic may only need to use one wrench (and thus one hand) to tighten each bolted joint for each auger segment. Thus, embodiments of the disclosed subject matter can help ease the overall disassembly of an old, worn auger segment and/or assembly of a new auger segment by providing a bolt head retention integrated directly into the auger segment itself.

Figure 10:
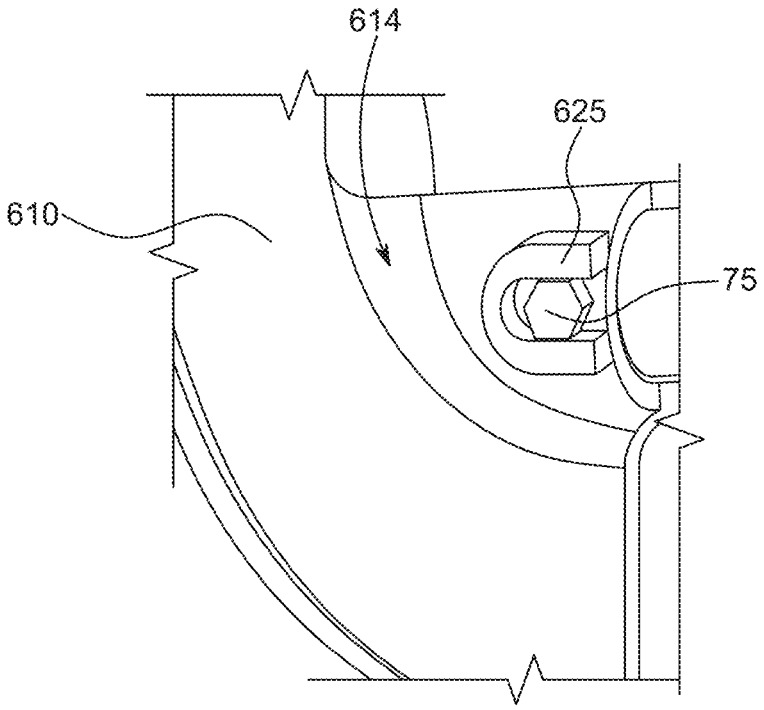
FIG. 10 is an enlarged perspective view of an auger segment removably coupled to an auger shaft according to one or more embodiments of the disclosed subject matter.

For instance, FIG. 10 shows opposite sides of a bolt head of the bolt 75 abutting opposite portions of inner wall portions of the first sidewall 625. In this example, that bolt 75 can sit on a floor of the first receptacle 620, fully in the first recess 622, where sides other than those abutting the inner wall portions of the first sidewall 625 may not abut any of the inner wall portions of the first sidewall 625.

Figure 9:
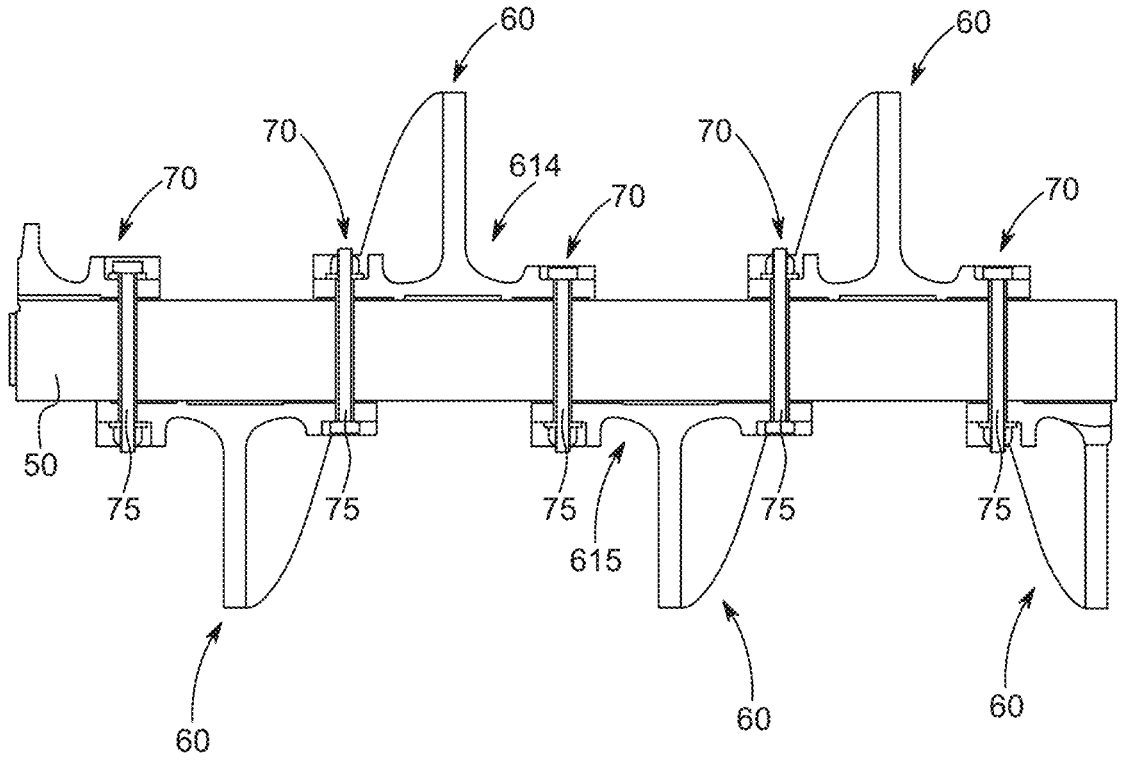
FIG. 9 is a sectional view of a portion of the auger shown in FIG. 3.

Referring now to FIG. 9, the fasteners 70 can alternate in orientation along the shaft 50. That is, each fastener 70 can face a different direction relative to each immediately adjacent fastener 70. In this regard, the fasteners 70 for each dual-fastener auger segment 60 can face different directions.

According to one or more embodiments, each bolt 75 can extend entirely through one auger segment 60 on one side of the shaft 50, the shaft 50 (via opposing through holes in the shaft 50), and another auger segment 60 on the other side of the shaft 50. Thus, one fastener 70, at least in part, can fasten two auger segments 60 to opposite sides of the shaft 50. Put another way, one fastener 70 can be shared by two auger segments 60.

As noted above, the bolts 75 can be alternately provided through the auger segments 60 and the shaft 50 such that the direction of the bolts 75 alternates between facing a first direction and facing a second direction along the length of the shaft 50. Thus, for one auger segment 60, the bolt 75 of one fastener 70 can extend through the auger segment 60 (and the shaft 50 and another auger segment 60 on an opposite side of the shaft 50) in the first direction and the bolt 75 another fastener 70 can extend through the auger segment 60 (after going through yet another auger segment 60 on the opposite side of the shaft 50 and the shaft 50) in the second direction opposite the first direction.

The bolt heads of the bolts 75 can be recessed in respective recesses of the receptacles (e.g., first receptacle 620). Likewise nuts 77 (and optional washers 79) of the fasteners 70 can be threaded onto the threaded ends of the bolts 75 such that the nuts 77 are recessed in respective recesses of the receptacles (e.g., second receptacle 630). Alternatively, the bolt heads may be flush with the tops of the sidewalls of their respective receptacles. The bolt heads and the nuts 77 being recessed within their respective recesses, i.e., at heights less than heights of respective sidewalls (e.g., first sidewall 625 and second sidewall 635) that define the receptacles or optionally flush can prevent or minimize buildup of paving material around the bolt heads and nuts 77. Optionally, ends of the bolts 75 opposite the bolt heads can extend above the sidewalls of their respective receptacles. However, over time such ends may wear so as to be at least flush with the tops of the sidewalls.

Such arrangement can also prevent wear on the fasteners 70 in that the sidewalls of the receptacles can provide abrasion protection for the fasteners 70 from potentially abrasive paving material as the auger segments 60 are rotated through the paving material. Thus, the fasteners 70 may be prevented from wearing out before the auger segment 60. In this regard, portions of the sidewall in one or both rotation directions of the shaft 50 can be relatively more thick than other portions of the sidewall to provide suitable wear protection.

The flight 610 of the auger segment 60 can extend from the body 601 between the first receptacle 620 and the second receptacle 630. However, the flight 610 may not directly contact the first receptacle 620 and/or the second receptacle 630. That is, respective spaces may be provided between the flight 610 and each of the first receptacle 620 and the second receptacle 630. As noted above, such spaces may be referred to herein as channels, particularly a first channel 614 and a second channel 615. Generally, the first channel 614 and the second channel 615 can be defined by a gradual transition according to a curvature from the flight 610 toward and to the body 601 and then to the first receptacle 620 and the second receptacle 630 on opposite sides of the flight 610. Here, a suitable transition or lead in radius (relatively large) for the curvature can be implemented in order to reduce stress concentration at the interface between the flight 610 and the base 601.

While aspects of the present disclosure have been particularly shown and described with reference to the embodiments above, it will be understood by those skilled in the art that various additional embodiments may be contemplated by the modification of the disclosed machines, assemblies, systems, and methods without departing from the spirit and scope of what is disclosed. Such embodiments should be understood to fall within the scope of the present disclosure as determined based upon the claims and any equivalents thereof.

The invention claimed is:

1. An auger assembly for a paving machine comprising:
- a shaft rotatable in a clockwise direction and a counterclockwise direction;
- at least one auger segment removably coupled to the shaft to rotate with the shaft; and
- a first bolt and nut fastener and a second bolt and nut fastener to removably couple the at least one auger segment to the shaft,
- wherein the at least one auger segment is formed in one-piece and includes:
  - a base having a first end portion, a second end portion opposite the first end portion in a length direction of the base, a first face, and a second face opposite the first face, the second face directly contacting the shaft,
  - a blade extending from the first face of the base between the first end portion and the second end portion,
  - a first receptacle to receive the first bolt and nut fastener, the first receptacle extending from the first face of the base,
  - a second receptacle to receive the second bolt and nut fastener, the second receptacle extending from the first face of the base,
  - a first channel between the blade and the first receptacle, and
  - a second channel between the blade and the second receptacle,
- wherein a first sidewall of the first receptacle is U-shaped,
- wherein a second sidewall of the second receptacle is U-shaped,
- wherein respective open faces of the U-shaped first and second sidewall face away from each other in the length direction of the base, and
- wherein a first sidewall of the first receptacle has a thickness greater than a second sidewall of the second receptacle.

2. The auger assembly according to claim 1,
- wherein the at least one auger segment includes at least two auger segments, the at least two auger segments alternating along the shaft so as to face opposite directions, and
- wherein the blades of the at least two auger segments form a continuous or substantially continuous helix shape along the shaft.

3. The auger assembly according to claim 2, wherein a bolt of the first bolt and nut fastener extends entirely through one auger segment of said at least two auger segments, the shaft, and another auger segment of said at least two auger segments.

4. The auger assembly according to claim 3, wherein a free end of the bolt projects from the second receptacle of said one auger segment of said at least two auger segments.

5. The auger assembly according to claim 1, wherein a first bolt of the first bolt and nut fastener extends entirely through the shaft in a first direction and a second bolt of the second bolt and nut fastener extends entirely through the shaft in a second direction opposite the first direction such that a bolt head of the first bolt and a nut of the second bolt and nut fastener are on a same side of the shaft.

6. The auger assembly according to claim 5, wherein the bolt head of the first bolt is recessed entirely below a first top surface of a first sidewall of the first receptacle and directly contacts opposite side portions of the first sidewall.

7. A method regarding an auger assembly for a paving machine comprising:
- providing a first auger segment adapted to be removably coupled to a rotatable shaft; and/or
- providing a second auger segment adapted to be removably coupled to the rotatable shaft,
- wherein each of the first and second auger segments includes:
  - a base having a first end, a second end opposite the first end in a length direction of the base, a first face, and a second face opposite the first face,
  - a flight extending from the first face of the base between the first end and the second end of the base,
  - a first receptacle at the first end of the base defining a first recess to receive a first fastener, the first receptacle extending from the first face of the base between the first end of the base and the flight,
  - a second receptacle at the second end of the base defining a second recess to receive a second fastener, the second receptacle extending from the first face of the base between the second end of the base and the flight, a first channel between the flight and the first receptacle, and a second channel between the flight and the second receptacle, and wherein, for each of the first auger segment and the second auger segment, a first sidewall of the first receptacle has a thickness greater than that of a second sidewall of the second receptacle and the first recess of the first receptacle has a volume less than that of the second recess of the second receptacle.

8. The method according to claim 7, further comprising providing the first and second fasteners, one of the first fastener or the second fastener being shared by the first and second auger segments.

9. The method according to claim 7, wherein said providing the first auger segment and said providing the second auger segment include removably coupling the first auger segment and the second auger segment to the rotatable shaft using the first fastener and the second fastener, respectively.

10. The method according to claim 9, wherein the first auger segment and the second auger segment face each other from opposite sides of the rotatable shaft.

11. The method according to claim 9, wherein the first auger segment and the second auger segment are on a same side of the rotatable shaft.

12. An auger segment comprising:

a base having a first end, a second end opposite the first end in a length direction of the base, a first side, and a second side opposite the first side;

a first receptacle projecting from the first side of the base;

a second receptacle projecting from the first side of the base; and a flight projecting from the first side of the base between the first receptacle and the second receptacle, wherein a first recess of the first receptacle is defined by a first sidewall thereof and a second recess of the second receptacle is defined by a second sidewall thereof, where in an elevational view of the auger segment from the first side a first inner perimeter of the first sidewall defining a first area of the first recess that is less than a second area defined by a second inner perimeter of the second sidewall, wherein a first through hole extends through the base in the first recess of the first receptacle, wherein a second through hole extends through the base in the second recess of the second receptacle, wherein each of the first sidewall and the second sidewall is U-shaped, wherein the first sidewall extends to the first end of the base, wherein the second sidewall extends to the second end of the base, and wherein respective open faces of the U-shaped first and second sidewalls face away from each other.

13. The auger segment according to claim 12, wherein the first wall of the first receptacle has a thickness greater than the second wall of the second receptacle.

14. The auger segment according to claim 12, further comprising:

a first channel between the flight and the first receptacle, and/or a second channel between the flight and the second receptacle.

15. The auger segment according to claim 12, wherein the first and second receptacles are the only receptacles of the auger segment.

16. The auger segment according to claim 12, wherein outer dimensions of the first sidewall and the second sidewall of the first and second receptacles, respectively, are the same.

* * * * *